United States Patent [19]

Fikse

[11] 3,966,256

[45] June 29, 1976

[54] TUNNELING EQUIPMENT

[75] Inventor: Tyman H. Fikse, Enumclaw, Wash.

[73] Assignee: The Robbins Company, Seattle, Wash.

[22] Filed: Apr. 11, 1975

[21] Appl. No.: 567,269

[52] U.S. Cl. ..... 299/33; 61/85; 214/133

[51] Int. Cl.[2] ..... E21D 9/08

[58] Field of Search ..... 299/31, 33, 72, 75, 299/70; 173/43; 214/131 A, 133, 1 CM; 198/10; 61/85; 248/179

[56] References Cited

UNITED STATES PATENTS

| | | | |
|---|---|---|---|
| 3,215,391 | 11/1965 | Storm | 248/179 X |
| 3,288,421 | 11/1966 | Peterson | 248/179 X |
| 3,556,599 | 1/1971 | Fikse | 299/33 X |
| 3,578,809 | 5/1971 | Cunningham | 299/33 |
| 3,612,609 | 10/1971 | Reuls | 299/33 |

*Primary Examiner*—Ernest R. Purser

*Attorney, Agent, or Firm*—Graybeal, Barnard, Uhlir & Hughes

[57] ABSTRACT

A cutting tool is mounted on the head of a support tripod, the legs of which are double-acting hydraulic cylinders. The rear ends of said cylinders are either pivotally connected to a frame portion of a tunneling machine or to movable barrel portions of three base cylinders having fixed rod portions. The cylinders are selectively extended and retracted for the purpose of moving the cutting tool forwardly and rearwardly and also up and down and sideways.

25 Claims, 16 Drawing Figures

Fig. 4
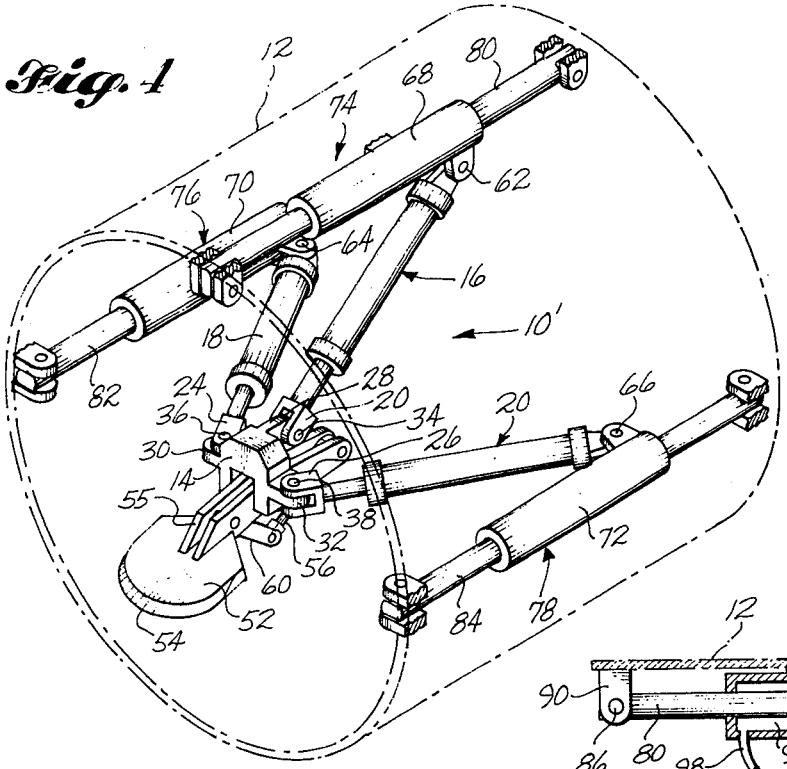
Fig. 5
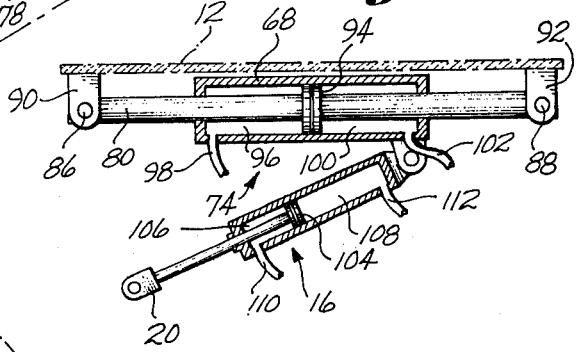
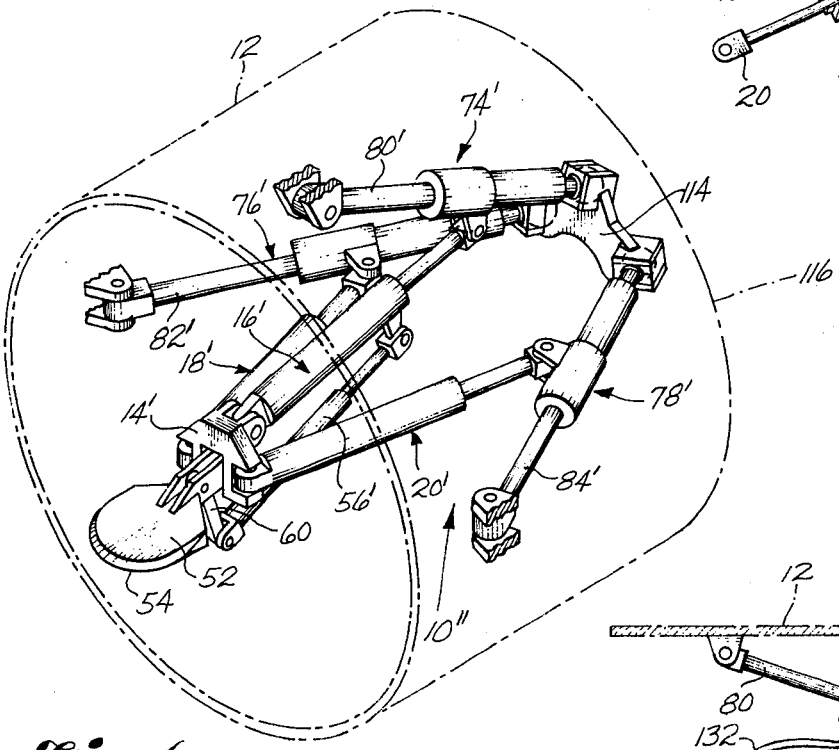
Fig. 6
Fig. 7
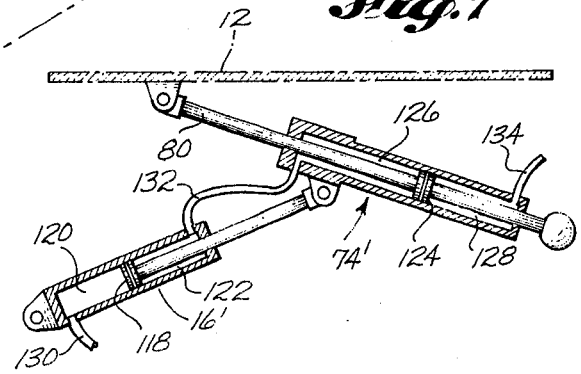

140
116
150
138
10''
148
12
136
74'
146
114
D
16'
76'
D
56'
84'
18'
14'
55
D
20'
60
54
144
136
52
150
148
142
146

TUNNELING EQUIPMENT

BACKGROUND OF THE INVENTION

1. Field of the Invention

This invention relates to power excavating equipment and its arrangement within a tunneling shield.

2. Description of the Prior Art

The excavating equipment and tunneling machine of this invention are deemed to be improvements over the excavating equipment and tunneling machine disclosed by my U.S. Pat. No. 3,556,599, granted Jan. 19, 1971. A primary advantage of the excavating equipment of this invention is that the hydraulic cylinders which are provided for moving the cutting tool also constitutes its support structure. An overhead truck, a carriage and a boom, such as shown by my U.S. Pat. No. 3,556,599, are not needed. This results in a substantial increase in the amount of room available for the workmen or for other equipment at the head of the tunnel.

SUMMARY OF THE INVENTION

The excavating equipment of this invention is essentially characterized by a tripod type of support and drive mechanism for a cutting tool. The cutting tool is mounted onto a head portion of the tripod mechanism. The three legs of the tripod are double-acting hydraulic cylinders. The forward ends of such cylinders are connected to the head of the tripod in much the same manner that the legs of a surveyor's tripod are connected to its head, i.e. the legs are mounted for pivotal movement about the chordwise axes but the connecting means is otherwise capable of transmitting moments. The rear ends of the tripod leg forming cylinders are mounted for universal movement. Fluid is delivered to and exhausted from the cylinders for the purpose of selectively lengthening and shortening the cylinders, to in this manner, move the cutting tool in essentially all directions across the face of the tunnel.

According to one aspect of the invention, the rear ends of the tripod leg forming cylinders are connected to traveling barrel portions of three base cylinders. The base cylinders extend generally longitudinally of the tunnel and include rod portions which are fixed in position. The barrel portions of the base cylinders both move longitudinally of, and rotate about, the rods portions.

The several cylinders are selectively extended and retracted for the purpose of translating the cutting tool. The cutting tool is hinge mounted on tripod head and is movable into a position wherein its cutting edge, which may be in the nature of a wedge, is directed generally normal to the tunnel face. The several cylinders are used for thrusting the cutting tool into the tunnel face for wedging loose sections of rock or other earth material.

The cutting tool also includes a relatively large area portion and said tool is movable into a position wherein said large area portion can be used as a drag loader. With the cutting tool so positioned, the several cylinders are retracted for the purpose of drawing the cutting tool and any loose earth material in its path rearwardly to a loading mechanism.

Other aspects of the invention are hereinafter described in connection with the illustrated embodiment.

BRIEF DESCRIPTION OF THE DRAWING

In the drawing like element designations refer to like parts, and:

FIG. 4 is a view like FIG. 1, but of a modified form of support means for the tool supporting tripod;

FIG. 5 is a fragmentary view, partially in section, showing the structural make-up of one base cylinder and one fore cylinder of the tool control mechanism of FIG. 4;

FIG. 6 is also a view like FIG. 1, but showing a third manner of supporting the support tripod for the cutting tool;

FIG. 7 is a view like FIG. 5, but of a related set of base and fore cylinders from the mechanism shown by FIG. 6;

DESCRIPTION OF THE PREFERRED EMBODIMENT

Figure 1:
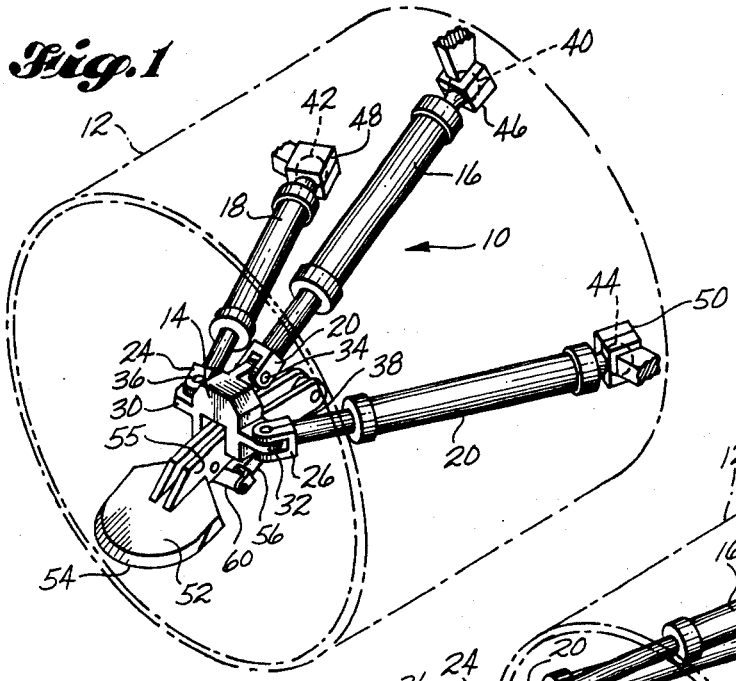
FIG. 1 is an isometric view looking from above and toward the front and one side of an excavating mechanism typifying the present invention, such view showing a cutting tool approximately centered relative to a tubular tunneling shield.
Figure 2:
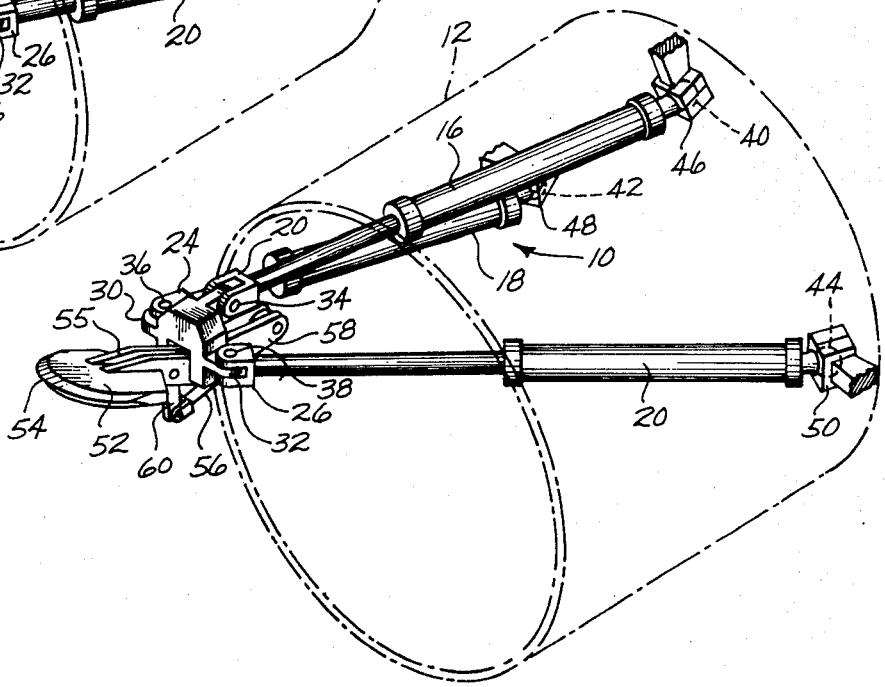
FIG. 2 is a view like FIG. 1, but showing the cutting tool moved forwardly, upwardly and to one side of a centered position.

Referring now to FIGS. 1 and 2, a tool supporting tripod 10 is shown within the confines of a shield 12, depicted by phantom lines. The tripod 10 comprises a support head 14 and three legs 16, 18, 20. The three legs are double-acting hydraulic cylinders. The clevis-like forward ends 22, 24, 26 of the cylinders 16, 18, 20, are pivotally attached to ear portions 28, 30, 32 of the support head 14, by means of pivot pins 34, 36, 38, or the like. The pivot pin joints permit relative movement about chordwise axes, i.e. the axes of pins 34, 36, 38. Such joints are otherwise capable of transmitting moments.

Universal joints are provided at the rear end of the cylinders 16, 18, 20. In the embodiment of FIGS. 1 and 2, ball members, 40, 42, 44 are shown at the rear ends of the cylinders 16, 18, 20. These ball members 40, 42, 44 are received within socket members 46, 48, 50 which are secured to sidewall portions of the shield 12.

Since the support tripod 10 has only three legs, the centers of the pivot joints 40, 46; 42, 48 and 44, 50 by necessity lie within a common plane. Preferably, such plane is a radial plane.

The cutting tool 52 is preferably a broad blade-like member having an arcuate edge 54 which in cross-section is preferably wedge shaped. By way of typical and therefore non-limitative example, the cutting tool 52 is connected to the front end of an arm 55 that is pivotally connected to the tool support 14 for pivotal movement about an axis which extends transversely of the tunnel. A small double-acting cylinder 56 is interconnected between a rear portion 58 of tool support 14 and a control lever portion 60 shown to depend from the tool arm 55.

In operation, hydraulic fluid is selectively introduced into and removed from the fluid chambers of the cylinders 16, 18 20, for extending and retracting the tool support 14, and also for moving the tool support 14 up and down and sideways.

Figure 3A:
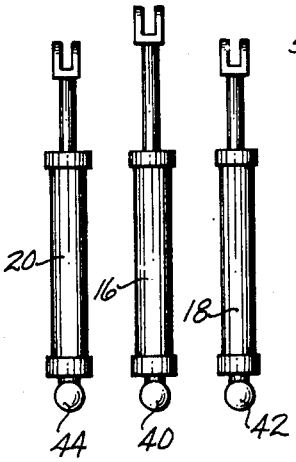
FIG. 3A is a diagram of the three cylinders of the support tripod shown in a common plane, and showing the relative extension of the three cylinders when the cutting tool is substantially centered as shown in FIG. 1.

Referring to FIG. 3A, which shows the three cylinders 16, 18, 20 side-by-side in a common plane. Owing to the selection of the connection points for the rear ends of the cylinders 16, 18, 20 to the shield 12, when the tool support 14 and the tool 52 carried thereby are substantially centered within the shield 12, the two side cylinders 18, 20 are extended an equal amount and the upper cylinder 16 is extended a slightly greater amount.

Figure 3C:
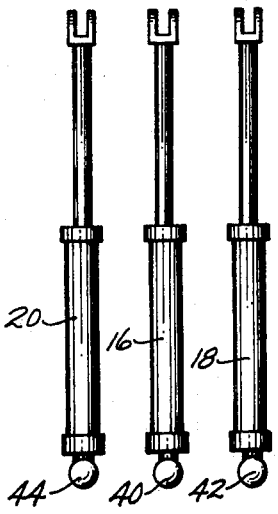
FIG. 3C is a view like FIGS. 3A and 3B, but showing the relative length adjustment of the three cylinders required for raising the extended tool upwardly from a substantially centered position.
Figure 3D:
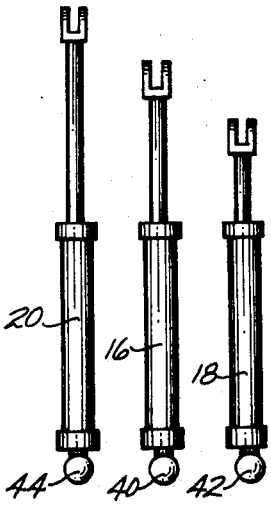
FIG. 3D is a view like FIGS. 3A – 3C, but showing the final length adjustment of the cylinders required for swinging the extended, raised tool over to the right side of the shield.
Figure 3B:
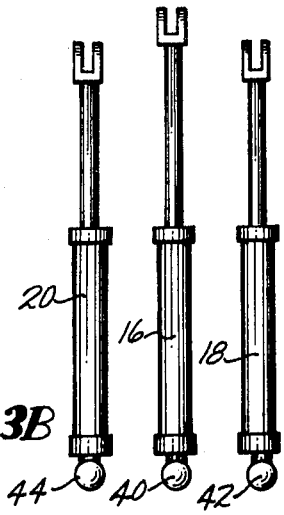
FIG. 3B is a view like FIG. 3A, but showing all three cylinders extended about an equal amount, to illustrate the change in length of the cylinders which must be made for the purpose of moving the cutting tool forwardly while still centered.

Referring now to FIG. 3B, if the operator wished to merely extend or translate the tool support 14 and the tool 52 forwardly, all three cylinders 16, 18, 20 would be further extended. If then, the operator wished to raise the tool support 14 and the tool 52, this could be done by further extending only the two side cylinders 18, 20. Perhaps aided by a retraction of the upper cylinder 16 (FIG. 3C). In order to continue on to the position shown by FIG. 2, the right side cylinder 18 is retracted a substantial amount and the upper cylinder 16 is retracted a smaller amount (FIG. 3D). This causes a sideways movement of the tool support 14 and the tool 56 towards the right side of the shield.

The purpose of FIGS. 3A – 3D is to diagrammatically illustrate the various relative movements of the cylinders 16, 18, 20 which are required for moving the tool 52 from the position shown in FIG. 1 to the position shown in FIG. 2. Of course, these movements need not be performed in a step-by-step fashion as described, but in actual practice maybe combined into a single continuous step. The diagrams 3B – 3D illustrate increments of extension or retraction of the cylinder 16, 18, 20. In actual practice it is preferred that the increments for each are algebratically added together to obtain a single amount of extension or retraction for each cylinder 16, 18, 20 which when achieved will result in a movement of the tool 14 from its starting place to a desired new location.

The mechanism shown by FIG. 4 is essentially like the mechanism shown by FIGS. 1 and 2, except that the rear ends of the cylinders 16, 18, 20 are pivotally connected by cross pins 62, 64, 66, to sliding barrel portions 68, 70, 72 of three base cylinders 74, 76, 78. In this embodiment the opposite ends of the rod portions 80, 82, 84 are connected to sidewall locations on the shield 12. The base cylinders 74, 76, 78 are also double-acting cylinders. They extend longitudinally of the shield 12 and in parallelism with each other. The cylinder barrels 68, 70 72 are rotatable about as well as slidable along the rods 80, 82, 84. This rotation, combined with pivotal movement about the axes 62, 64, 66, establish a universal type mount for the rear ends of the forward or fore cylinders 16, 18, 20. Th advantage of this arrangement over the arrangement shown by FIGS. 1 and 2 is that the position of the rear ends of the cylinders 16, 18, 20 can be moved forwardly and rearwardly, to increase the amount of translation of the tool 52.

FIG. 5 is a longitudinal sectional view of the upper base cylinder 74 and the fore cylinder 16 paired therewith. Preferably, the other two sets of base and fore cylinders are of like construction, so they are not separately illustrated.

The front and rear ends of the rods 82 are shown to be pin connected at 86, 88 to front and rear brackets 90, 92 which are welded or otherwise secured to the shield 12. A piston head 92 is provided on rod 82, intermediate its ends, piston head 92 divides the interior of cylinder barrel 68 into two chambers, one on each side of the piston head 92. The forward chamber 96 is provided with an inlet-outlet conduit 98 and the rearward chamber 100 is provided with an inlet-outlet conduit 102. As will be evident, when fluid is introduced into chamber 100 and exhausted out from chamber 90, the cylinder barrel 68 is moved rearwardly along rod 82. When the direction of fluid supply and removal is reversed, cylinder barrel 68 is moved forwardly along rod 82. The rod portion of fore cylinder 16 also includes a piston head 104 which divides the barrel portion of the cylinder 16 into front and rear chambers 106, 108. Front chamber 106 includes an inlet-outlet conduit 110 and the rearward chamber 108 includes an inlet-outlet conduit 112. As will be evident, when fluid is introduced into chamber 108 and removed from chamber 106, the rod portion of the cylinder is extended and the tool support 14 is moved forwardly. When the direction of fluid flow is reversed, the rod is retracted and the tool support 14 is moved rearwardly.

The two cylinders 16, 68 may be independently operated, or may be interconnected in series, so that they always operate together, as will hereinafter be described in connection with the next embodiment.

The embodiment shown by FIG. 6 is like the embodiment shown by FIG. 4, except that the rear ends of the rods 80, 82, 84 are not connected to a common support member 114 by a suitable moment carrying connection 115. An advantage of this arrangement is that it makes it possible to locate the rear boundary 116 of the shield 12 forwardly of the rear ends of the base cylinders 74, 76, 78 (see FIGS. 9 and 10). When the rear ends of the base cylinder rod 80, 82, 84 are connected to the shield 12, it makes it necesary to extend the shield rearwardly at least to the location of the rear mounts. In the embodiment shown by FIG. 6 (and by FIGS. 8 – 10), the rear boundary 116 of the shield 12 can be located substantially forwardly of the connector member 114.

As shown by FIG. 7, in the embodiment of FIG. 6 the rear chamber of each fore cylinder is in fluid communication with the forward chamber of its base cylinder, i.e. the two cylinders are connected together in series. This arrangement will now be more specifically described in connection with the upper set of fore and base cylinders 16, 74. The fore cylinder piston head 118 divides the fore cylinder barrel into a forward chamber 120 and a rearward chamber 122. A piston head 124 on base cylinder rod 80 divides the base cylinder barrel into a forward chamber 126 and a rearward chamber 128.

Forward chamber 120 of fore cylinder 16 is provided with an inlet-outlet conduit 130. A transverse conduit 132 is interconnected between the rear chamber 122 of fore cylinder 16 and the forward chamber 126 of base cylinder 74. The rear chamber 128 of base cylinder 74 is provided with an inlet-outlet conduit 134. Now, when fluid is introduced through conduit 134 into chamber 128, and removed from chamber 120 via conduit 130, base cylinder 74 is moved rearwardly along rod 80. As it moves the fluid in chamber 126 is transferred via conduit 132 into chamber 122, causing the barrel of fore cylinder 16 to move rearwardly along the rod of such cylinder. A reversal of the flow of fluid through conduits 130, 134 causes movement of the two cylinder barrels in the opposite direction. This operation of the two cylinders 16, 74 will be discussed in greater detail in conjunction with FIGS. 12 and 13.

Figure 8:
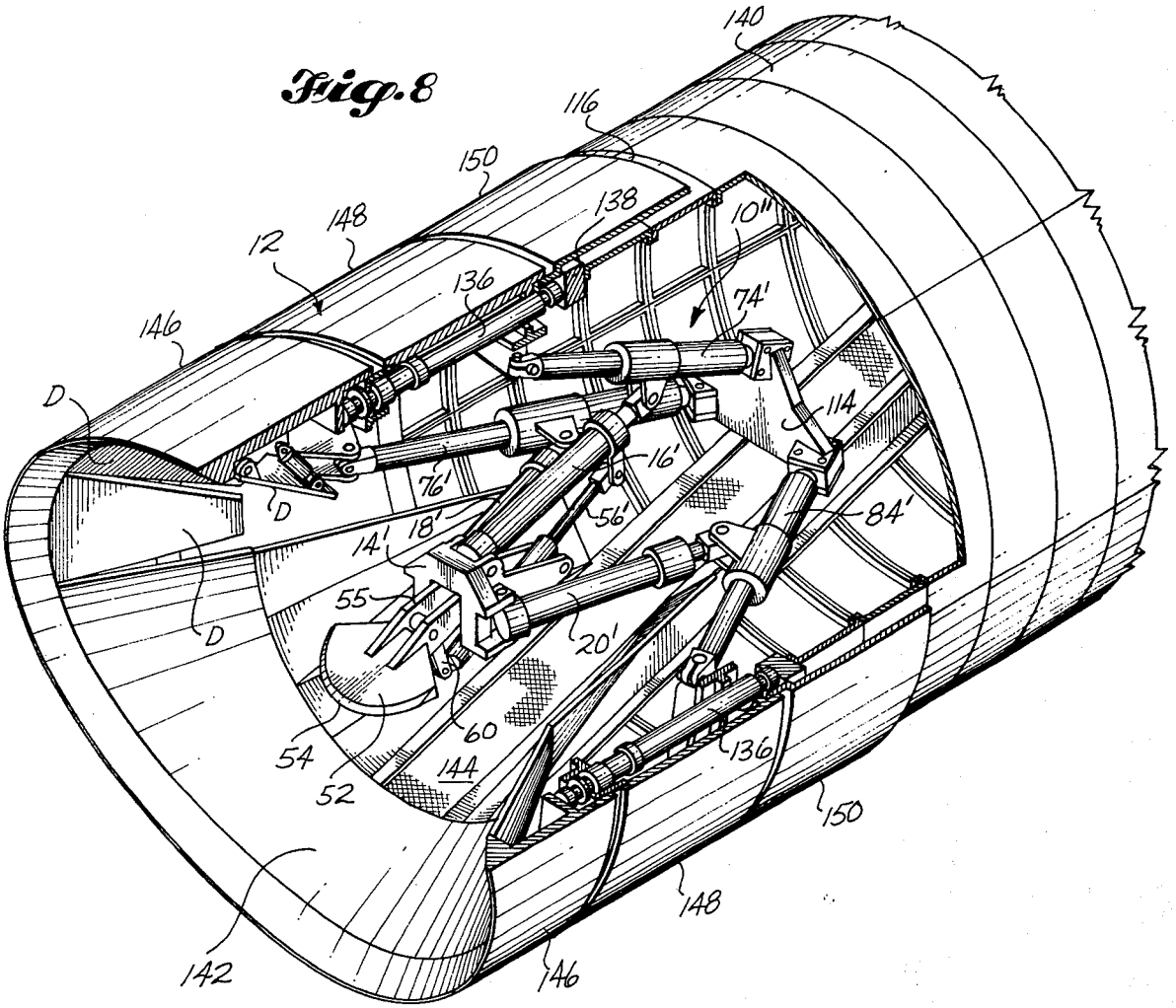
FIG. 8 is an enlarged scale isometric view with a foreground portion cut away, taken from above and looking towards the front and one side of a shield type tunneling machine embodying the excavating mechanism of this invention, said machine being shown in conjunction with a lined portion of a tunnel immediately behind the machine, said view including a portion of a conveyor which is provided for starting movement of the cut earth rearwardly through the tunnel.
Figure 9:
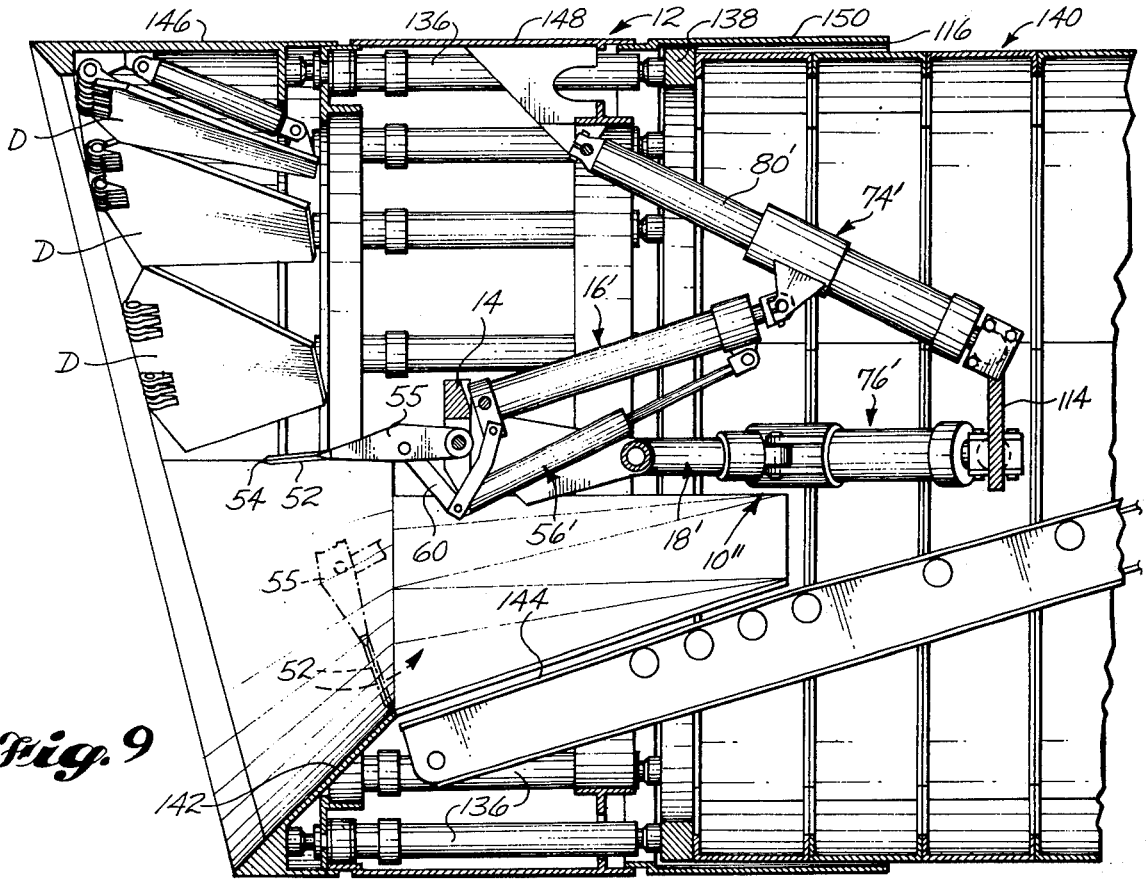
FIG. 9 is a longitudinal vertical sectional view of the embodiment of FIG. 8, with some parts in side elevation, said view showing the cutting tool substantially centered relative to the shield.
Figure 10:
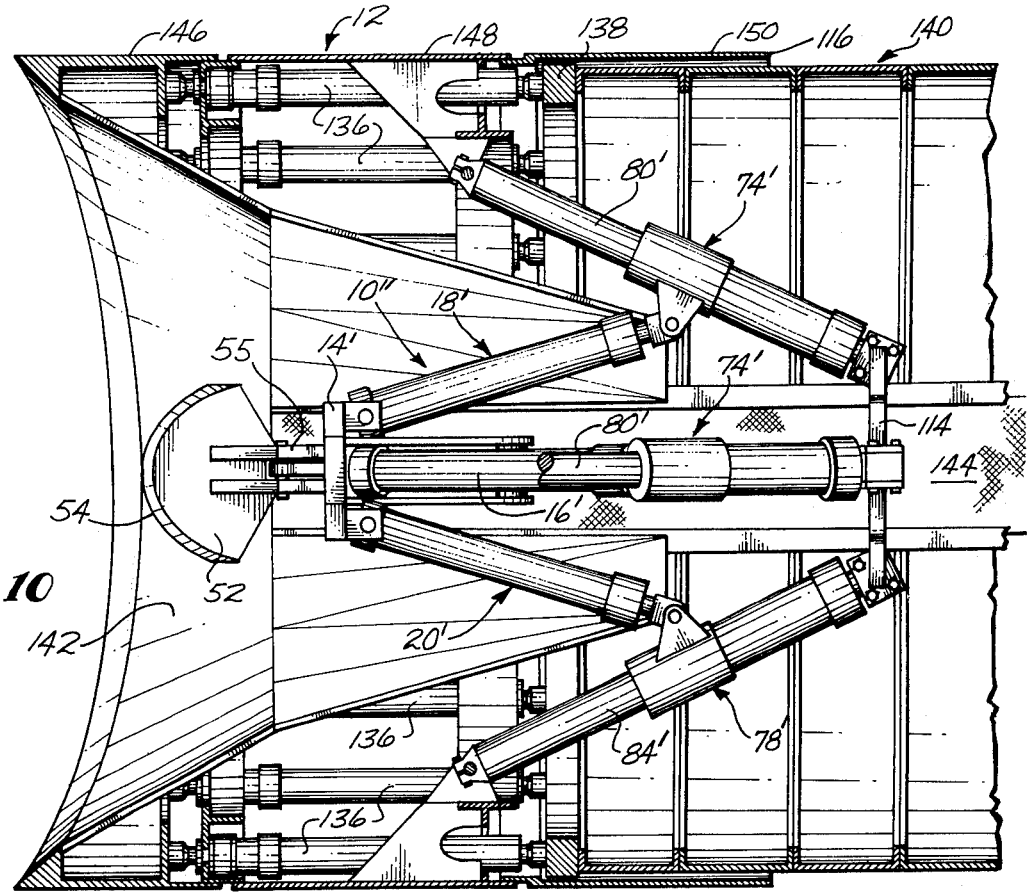
FIG. 10 is a longitudinal horizontal sectional view taken through the shield, with the excavating mechanism shown in top plan and in the same position that it occupies in FIG. 9.
Figure 11:
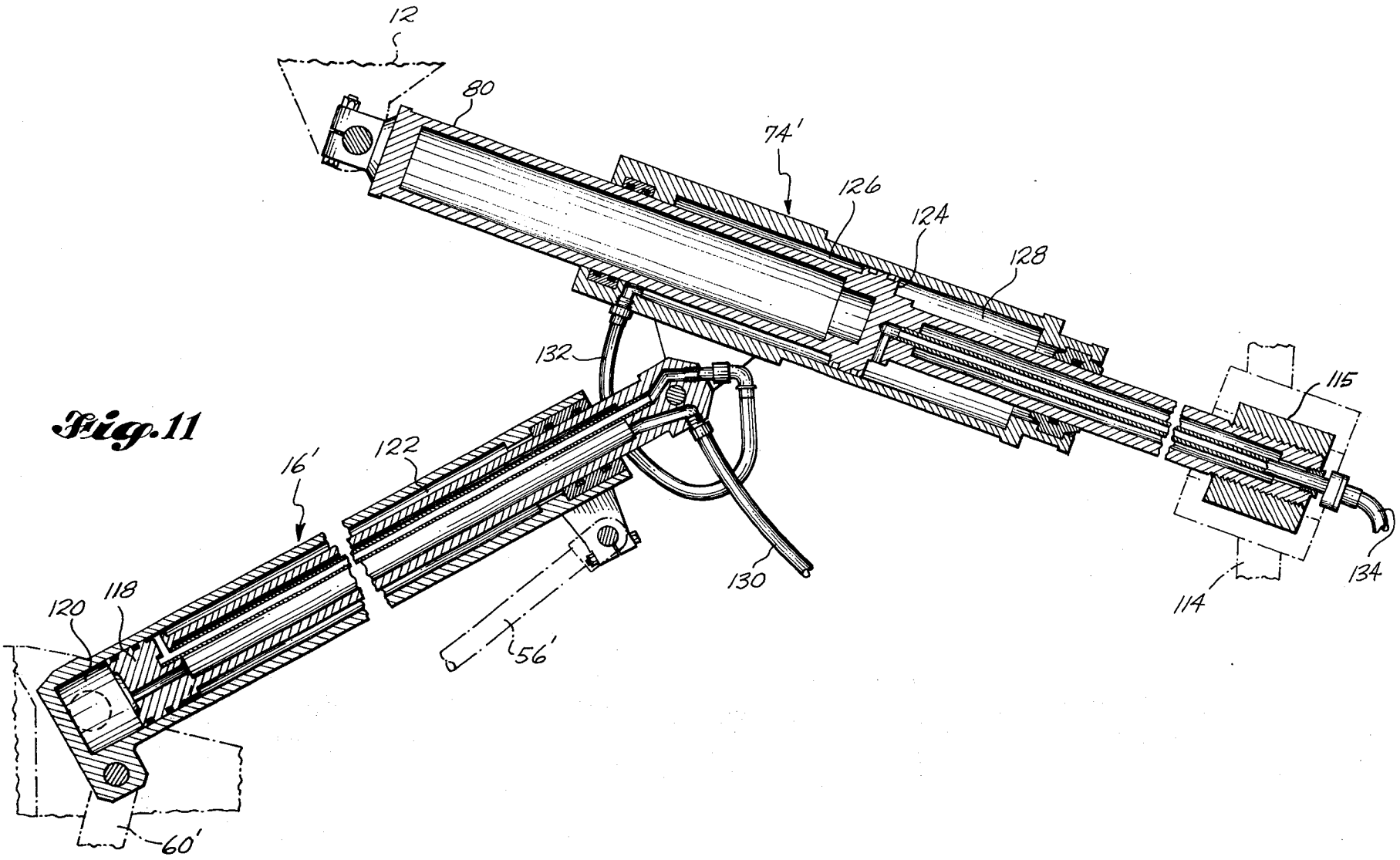
FIG. 11 is a view similar to FIG. 7, but of the upper base cylinder and the upper fore cylinder of the mechanism shown by FIGS. 8 – 10.

FIGS. 8 – 10 show excavating equipment of the type described above in connection with FIG. 6 inside of a tunneling shield 12 which is basically like the tunneling shield disclosed by my aforementioned U.S. Pat. No. 3,556,599.

The shield 12 includes a plurality of thrust rams 136 which are double-acting hydraulic cylinders, the barrel portions of which are firmly secured to a central frame portion of the shield 12. Thrust rams 136 include rearwardly extendible piston rods which make contact with a husky ring beam 138.

As is conventional in the tunneling field, a tunnel lining is constructed as the tunneling machine or shield 12 is advanced forwardly. The tunnel lining 140 is continuously added onto, and extended forwardly as the shield 12 is advanced forwardly. The illustrated form of tunnel lining is composed of sectional rings which are secured together end-to-end in the tunnel. Each ring is made up of a plurality of arcuate members or sections. The ring beam 138 abuts against the forward most ring of the lining 140. When the thrust arms 136 are extended they push rearwardly against the ring beam 138 which in turn pushes rearwardly against the immovable tunnel lining 140. This results in the shield 12 and the excavating equipment carried thereby being moved forwardly relative to the tunnel lining 140. After the shield 12 has been shoved forwardly an amount approximately equal to the full throw of the thrust rams 136, the thrust rams 136 are retracted, drawing the ring beam 138 forwardly. Then, a new ring of tunnel lining is constructed ahead of the last ring, within the space existing between said last ring and the advanced ring beam 138. As should be apparent, the shield 12 serves to support the earth material in the region where excavation is taking place and the tunnel lining supports the tunnel in its extent rearwardly of the shield 12.

The power excavator 10'' is used for both (1) digging or mining the tunnel face and (2) drawing the mined material rearwardly and up a ramp 142 to be discharged therefrom onto an endless belt type conveyor 144, or the like. Conveyor 144 moves such material rearwardly and deposits it into some mining cars or onto some other form of material carry-out means (e.g. another conveyor).

In operation of excavating mechanism 10'', the several cylinders are appropriately operated for the purpose of swinging the cutting tool 52 into a desired position relative to the tunnel face. The cutting tool 52 itself is oriented so that its cutting edge 54 is directed towards the tunnel face. Then, the fore cylinders (and perhaps the base cylinders also) are extended for the purpose of forcing the cutting edge 54 into the tunnel face, causing it to split off chunks of the earth material. After a substantial amount of the earth material has accumulated at the base of the ramp 142, the wrist piston 56' is retracted for the purpose of swinging the flat body portion of cutting tool 52 into a loading position (the broken line position of FIG. 9). Then, the fore and/or base cylinders are retracted for the purpose of drawing (translating) cutting tool 52 rearwardly, so that it will serve as a drag loader for the conveyor 144.

As will be apparent, the wrist cylinder 56' and the control linkage 60 constitute means for adjustably affixing the cutting tool 52 into two different positions, i.e. a cutting position and a loading position. The system of cylinders 16', 18', 20', 74', 76', 78' serve to translate the cutting tool 52 forwardly towards the cutting face, serve to swing cutting tool 52 up or down and/or sideways, serve to force the cutting edge 54 into the cutting face, serve to orient the tool 52 for loading, and serve to draw the tool 52 rearwardly to cause loading.

As should be apparent, a considerable amount of work room is saved by use of the support and drive cylinder system of this invention. In the embodiment of FIGS. 8 – 10, the space surrounding the base cylinder tripod is never occupied by any portion of the excavating mechanism, and considerable space exists inside the base cylinder tripod, as the fore cylinder tripod occupies only a relatively small amount of space.

The shield 12 is shown to include breasting doors D of the same general type as shown by my aforementioned U.S. Pat. No. 3,556,599. These breasting doors D form no part of this invention and they will not be described any further.

A tunneling machine of the present invention will have a substantially greater amount of power than the machine shown by my aforementioned U.S. Pat. No. 3,556,599 even though it possesses smaller excavating equipment. In the embodiment shown by FIGS. 8 – 10, all six cylinders are operated together to move the tool sideways and/or up and down and to translate the tool. The cutting tool 52 is capable of breaking concrete or rock of similar hardness. When used for cutting the tool 52 is oriented to enter the face of the tunnel edgewise and hydraulic power is applied to the cylinders for forcing it endwise. Essentially axial loads are imposed on the cylinders when they are extended for the purpose of forcing the tool 52 into the tunnel face.

A valving system is required which can be operated to selectively supply and exhaust the cylinders in the same manner described for the purpose of achieving the desired function. As should be apparent, the particular valving system can vary from one installation to another.

Figure 12:
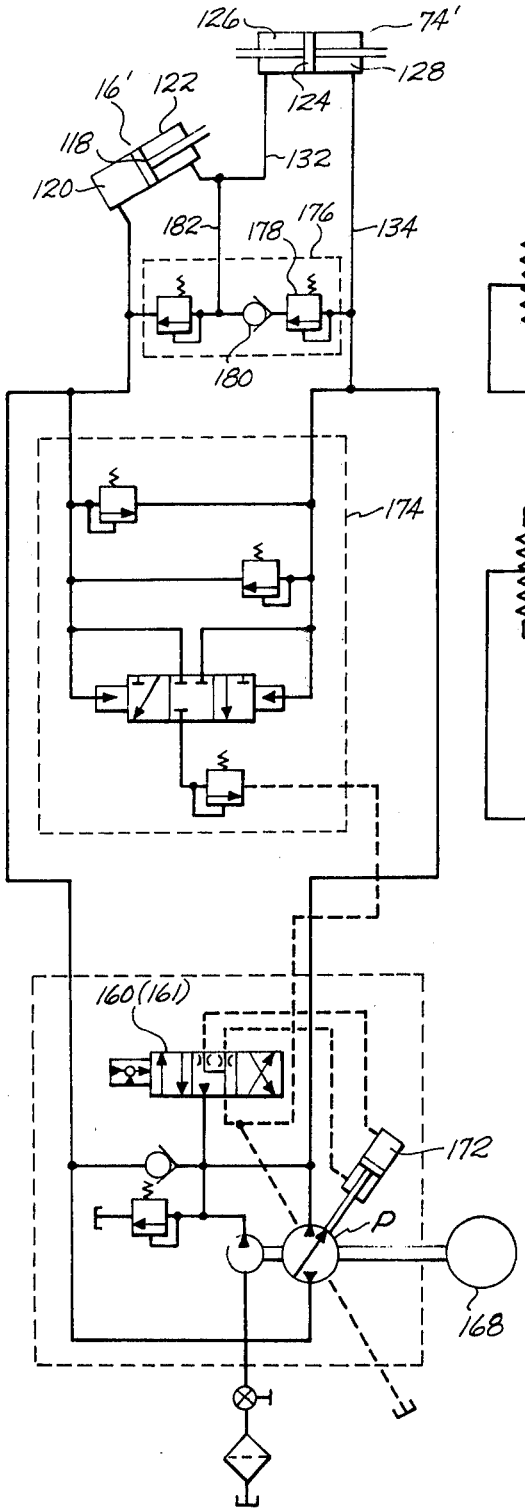
FIG. 12 is a schematic view of the hydraulic circuit for one of the cylinder sets.
Figure 13:
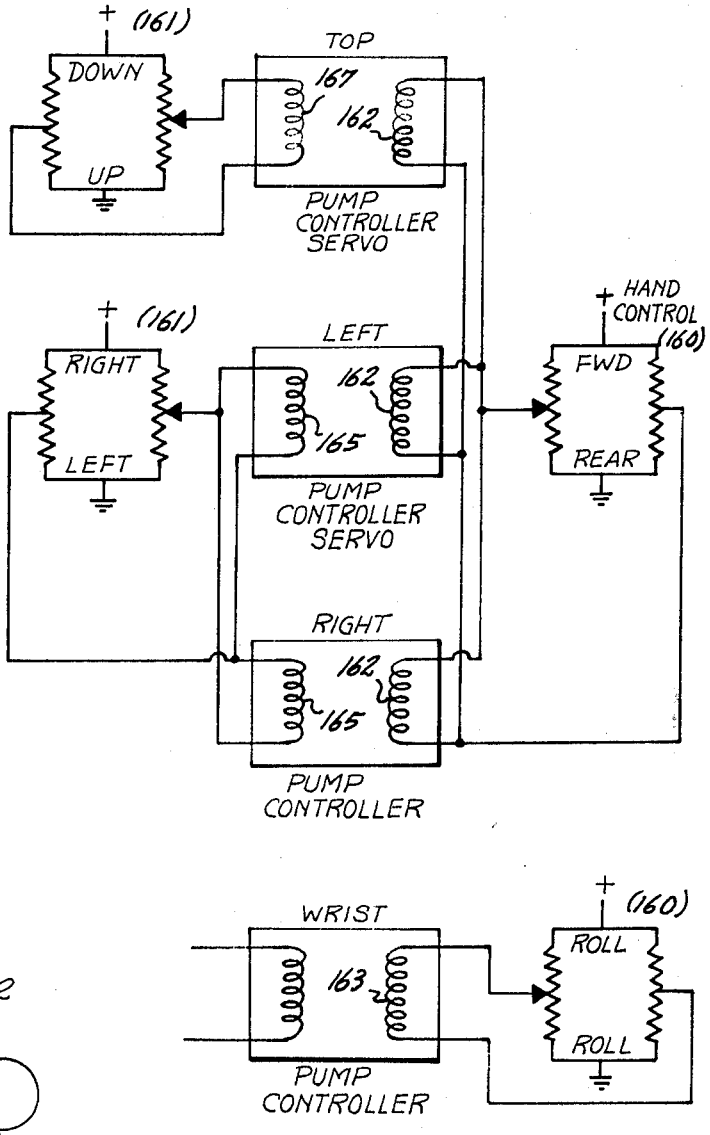
FIG. 13 is a block diagram of a control mechanism for the three supply pumps for the three cylinder sets.

By way of typical and therefore non-limitative example, FIGS. 12 and 13 are schematic diagrams of a control system suitable for use with the embodiment shown by FIGS. 8 – 10. FIG. 12 is a schematic diagram of a hydraulic circuit which is provided for each fore cylinder — base cylinder set, i.e. each other fore cylinder — base cylinder set includes an identical hydraulic circuit. FIG. 13 is a schematic diagram of the control equipment for the three pumps which are included in the fore cylinder — base cylinder hydraulic circuit, and for the pump which is in the hydraulic circuit for the wrist cylinder 56'.

Referring first to FIG. 13, a first axis control of a two axis control mechanism 160 is shown connected to first coils 162 for the electro-hydraulic pump controllers for each pumps P. Such first axis control mechanism 160 controls forward and back movement of all cylinders simultaneously. The second axis of mechanism 160 may be connected to a controller coil 163 for the pump supplying the wrist action cylinder 56. A first axis of a second two axis control mechanism 161 may be connected to second controller coils 165 for the two side cylinder sets with reversed polarity connection. The second axis of the mechanism 161 may be connected to the second controller coil 167 for the top cylinder set.

Referring now to FIG. 12, one of the reversible variable displacement pumps P is shown being driven by electric motor 168. By way of typical and therefore non-limitative example, the pump P may be of the type manufactured by Sunstrand Corp. of Ames, Ohio 50010, such as disclosed on pages 25 and 26 of such company's Bulletin No. 9582-A, dated January, 1972. Pump P includes a charge pump 170 and a control cylinder unit 172, of the type disclosed by such bulletin. Each controller 162, 163, 165, 167 may be like a coil in the Moog electric servo controller Model 62-500.

The hydraulic circuit is preferably equipped with a main loop replenish system 174 of the type shown in combination with the variable displacement motor in the aforementioned Bulletin 9582-A. Also, it is provided with a synchronizing mechanism 176 for the fore cylinder 16' and the base cylinder 74'. Preferably, the volume of chamber 120 is made to equal the volume of chamber 128 and the volume of chamber 122 is made to equal the volume of 126. During continuous operation of the excavator some leakage will occur from the chambers 122, 126. Mechanism 176 serves to make up any lost fluid during a retraction of the cylinders. If some fluid is lost, piston 124 will bottom before piston 118. When this happens the high pressure in line 134 will move valve 178, allowing some of the fluid to open check valve 180 and flow through line 182 into line 132. Once in line 132 such fluid will enter chamber 122, finishing the stroke of piston 118 and also replacing the lost fluid.

It is to be understood that the various illustrated embodiments represent preferred embodiments and the current best mode of practicing the invention. However, it is to be understood that the physical form of the machine can vary considerably from what is shown and that the invention is composed of the features and combination of features which are set forth in the appended claims. For example, although the excavating mechanism is shown to include tripod arrangement of the cylinders, it is within the scope of this invention for a greater number of cylinders to be employed. Hence, some of the claims specify "at least three cylinders", and are to be interpreted to include three or more cylinders per mechanism. Also, although the invention has been shown in connection with a shield type tunneling machine for excavating a horizontal tunnel, the invention is not necessarily directionally oriented. This fact should be taken into consideration when interpreting the claims.

What is claimed is:

1. An excavating mechanism for use in a tunneling machine that is advanced in the tunnel as excavation proceeds, said mechanism comprising:

a cutting tool;

a support tripod for said cutting tool comprising a tool mounting head and three double-acting hydraulic cylinders forming three variable length support and drive legs, each said cylinder having a forward end and a rearward end, and means connecting the forward end of said cylinders to said mounting head for pivotal movement about chordwise axes, said means otherwise transmitting moments between said mounting head and said cylinders, said cylinders being adapted to in use diverge rearwardly from said tool mounting head, and wherein the rearward ends of said cylinders are adapted to be mounted for universal pivotal movement and said cylinders are adapted to in use be selectively extended and retracted for moving said cutting tool forwardly and rearwardly and in substantially all directions across the tunnel face; and means mounting said cutting tool onto said tool mounting head.

2. An excavating mechanism according to claim 1, further comprising means mounting said cutting tool onto said tool mounting head for pivotal movement about an axis which is transverse to the tunnel, and means for adjustably affixing the cutting tool in position relative to the tool mounting head.

3. An excavating mechanism according to claim 2, wherein said cutting tool includes an elongated wedge-like cutting edge.

4. An excavating mechanism according to claim 1, wherein one of the double-acting hydraulic cylinders of the support tripod occupies a central upper position and the other two double-acting hydraulic cylinders occupy side positions.

5. An excavating mechanism according to claim 4, further comprising means mounting said cutting tool onto said tool mounting head for pivotal movement about an axis which is transverse to the tunnel, and means for adjustably affixing the cutting tool in position relative to the tool mounting head.

6. A tunneling machine comprising a tubular shield that is advanced in the tunnel as excavation proceeds; and an excavating mechanism comprising:

a cutting tool;

a support tripod for said cutting tool comprising a tool mounting head and three double-acting hydraulic tool positioning cylinders forming variable length support and drive legs, each said cylinder having a forward end and a rearward end, and means connecting the forward ends of said cylinders to said mounting head for pivotal movement about chordwise axes, said means otherwise transmitting moments between said mounting head and said cylinders, with said cylinders diverging rearwardly from said tool mounting head;

means mounting said cutting tool onto said mounting head;

means mounting said support tripod onto said tubular shield including means mounting the rearward ends of said cylinders for universal pivotal movement; and hydraulic fluid supply and return and control means for selectively extending and retracting said double-acting hydraulic cylinders, for moving said cutting tool forwardly and rearwardly and in substantially all directions across the tunnel face.

7. A tunneling machine according to claim 6, comprising universal mounting means connecting the rearward ends of the cylinders with circumferentially spaced apart locations on said shield.

8. A tunneling machine according to claim 6, comprising three base cylinders, each including a rod portion which is connected with said shield and a barrel portion which is both slidable along and rotatable about said rod portion, and wherein the rear end of each said tool positioning cylinder is pivotally connected to the barrel of a related base cylinder.

9. A tunneling machine according to claim 8, wherein each tool positioning cylinder is connected in series with its base cylinder.

10. A tunneling machine according to claim 8, wherein the rod portions of said base cylinders extend axially of the shield and in parallelism with each other.

11. A tunneling machine according to claim 8, wherein the three base cylinders converge rearwardly and also form a tripod, and each base cylinder is a double-acting hydraulic cylinder and includes a fixed rod portion having a forward end which is connected with the shield and a rearward end, and a connector member to which the rear ends of the base cylinder rod members are attached.

12. A tunneling machine according to claim 11, wherein the shield includes a rear boundary which terminates axially forwardly of the connector member.

13. A tunneling machine according to claim 11, wherein each tool positioning cylinder is connected in series with its base cylinder.

14. A tunneling machine according to claim 11, further comprising means mounting said cutting tool on said tool mounting head for pivotal movement about an axis which is transverse to the tunnel, and means for changing the position of said cutting tool relative to the tool mounting head.

15. An excavating mechanism according to claim 14, wherein one of the tool positioning cylinders occupies an upper central position and the other two tool positioning cylinders occupy side positions, and said means for changing the cutting tool relative to the tool mounting head comprises a double-acting hydraulic cylinder that is interconnected between said cutting and the upper central tool positioning cylinder.

16. A tunneling machine comprising a tubular shield that is advanced in the tunnel as excavation proceeds; and an excavating mechanism comprising:

cutting tool;

a support tripod for said cutting tool comprising a tool mounting head and three double-acting hydraulic fore cylinders forming variable length support and drive legs, each said fore cylinder having a forward end and a rearward end, and means connecting the forward ends of said fore cylinders to said mounting head for pivotal movement about chordwise axes, said means otherwise transmitting moments between said mounting head and said fore cylinders, with said fore cylinders diverging rearwardly from said tool mounting head;

three base cylinders extending generally longitudinally of the shield and each including a rod portion which is connected with said shield and a barrel portion which is both slidable along and rotatable about said rod portion;

means pivotally connecting the rearward end of each said fore cylinder to the barrel of a related base cylinder; and control means for selectively extending and retracting said fore and base cylinders, for moving said cutting tool forwardly and rearwardly and in substantially all directions across the tunnel face.

17. A tunneling machine according to claim 16, wherein one of the fore cylinders and a related base cylinder occupy upper central positions and the other two fore cylinders and their related base cylinders occupy side positions.

18. A tunneling machine according to claim 17, further comprising means mounting said cutting tool on said tool mounting head for pivotal movement about an axis which is transverse to the tunnel, and means for adjustably affixing the cutting tool in position relative to the tool mounting head.

19. A tunneling machine according to claim 16, wherein each fore cylinder is connected in series with its base cylinder.

20. An excavating mechanism that is advanced through the ground as excavation proceeds, said mechanism comprising:

a cutting tool;

a multipod support for said cutting tool comprising a tool mounting head and at least three double-acting hydraulic cylinders forming three variable length support and drive legs, each said cylinder having a forward end and a rearward end, and means connecting the forward ends of said cylinders to said mounting head for pivotal movement about chorwise axes, said means otherwise transmitting moments between said mounting head and said cylinders, said cylinders being adapted to in use diverge rearwardly from said tool mounting head, and wherein the rearward ends of said cylinders are adapted to be mounted for universal pivotal movement and said cylinders are selectively extended and retracted for moving said cutting tool forwardly and rearwardly and in substantially all directions across the tunnel face; and means mounting said cutting tool onto said tool mounting head.

21. An excavating mechanism according to claim 1, further comprising means mounting said cutting tool onto said tool mounting head for pivotal movement about an axis which is transverse to the tunnel, and means for adjustably affixing the cutting tool in position relative to the tool mounting head.

22. An excavating mechanism according to claim 2, wherein said cutting tool includes an elongated wedge-like cutting edge.

23. A tunneling machine comprising a tubular shield that is advanced in the tunnel as excavation proceeds; and an excavating mechanism comprising:

a cutting tool;

a multipod support for said cutting tool comprising a tool mounting head and at least three double-acting hydraulic fore cylinders forming variable length support and drive legs, each said fore cylinder having a forward end and a rearward end, and means connecting the forward ends of said fore cylinders to said mounting head for pivotal movement about chordwise axes, said means otherwise transmitting moments between said mounting head and said fore cylinders, with said fore cylinders diverging rearwardly from said tool mounting head;

a base cylinder for each fore cylinder extending generally longitudinally of the shield and each including a rod portion which is connected with said shield and a barrel portion which is both slidable along and rotatable about said rod portion;

means pivotally connecting the rearward end of each said fore cylinder to the barrel of a related base cylinder; and control means for selectively extending and retracting said fore and base cylinders, for moving said cutting tool forwardly and rearwardly and in substantially all directions across the tunnel face.

24. A tunneling machine according to claim 23, further comprising means mounting said cutting tool on said tool mounting head for pivotal movement about an axis which is transverse to the tunnel, and means for adjustably affixing the cutting tool in position relative to the tool mounting head.

25. A tunneling machine according to claim 23, wherein each fore cylinder is connected in series with its base cylinder.

* * * * *

UNITED STATES PATENT OFFICE

CERTIFICATE OF CORRECTION

Patent No. 3,966,256 Dated June 29, 1976

Inventor(s) Tyman H. Fikse

It is certified that error appears in the above-identified patent and that said Letters Patent are hereby corrected as shown below:

Column 3, line 27, the word -- cutting -- should be inserted after " arcuate " .

Column 7, line 36, the word -- an -- should be inserted before "electric".

Claim 20, line 50, the word "chorwise" should be -- chordwise --.

Claim 21, line 63, "1" should be -- 20.

Claim 22, line 1, change "2" to -- 21.

Signed and Sealed this

Tenth Day of May 1977

[SEAL]

*Attest:*

RUTH C. MASON
*Attesting Officer*

C. MARSHALL DANN
*Commissioner of Patents and Trademarks*